US006172586B1

(12) United States Patent
Ferree et al.

(10) Patent No.: US 6,172,586 B1
(45) Date of Patent: Jan. 9, 2001

(54) TERMINAL BARRIER SYSTEM FOR MOLDED CASE CIRCUIT BREAKER

(75) Inventors: James F. Ferree, Lawrenceville; W. Dale Robbins, Lithonia; Michael W. Souza, Social Circle; Stacey L. Duvall, Atlanta; James H. Blessitt, Peachtree City; Peter P. Clickner, Lawrenceville, all of GA (US)

(73) Assignee: Siemens Energy & Automation Inc., Alpharetta, GA (US)

( * ) Notice: Under 35 U.S.C. 154(b), the term of this patent shall be extended for 0 days.

(21) Appl. No.: 09/434,232

(22) Filed: Nov. 5, 1999

(51) Int. Cl.[7] ..... H01H 9/02
(52) U.S. Cl. ..... 335/202; 439/810; 335/6
(58) Field of Search ..... 335/6, 8–10, 201, 335/202; 200/293–305; 218/154, 155–157; 439/810–814

(56) References Cited

U.S. PATENT DOCUMENTS

| | | | | |
|---|---|---|---|---|
| 4,905,122 | | 2/1990 | Culnan et al. | 361/376 |
| 5,084,689 | * | 1/1992 | Morgan et al. | 335/202 |
| 5,107,396 | | 4/1992 | Rosen et al. | 361/355 |
| 5,301,086 | | 4/1994 | Harris et al. | 361/641 |
| 5,488,337 | * | 1/1996 | Habbard et al. | 335/202 |
| 5,772,479 | * | 6/1998 | Fleege et al. | 439/801 |
| 5,811,749 | | 9/1998 | Bausch et al. | 218/157 |
| 5,831,498 | * | 11/1998 | Maloney et al. | 335/8 |

* cited by examiner

*Primary Examiner*—Lincoln Donovan
*Assistant Examiner*—Tuyen T. Nguyen

(57) ABSTRACT

A circuit breaker (10) including a terminal barrier system (140). The terminal barrier system (140) includes a terminal barrier (142) attached to a circuit breaker base (12) at the terminals (16, 18), line and load, of the breaker (10) and a terminal connector (144) mounted in the terminal barrier (142) to align with a terminal (16, 18) of the breaker (10). Several embodiments of the terminal barrier (142) and terminal connector (144) are provided which allow flexibility in combining the various terminal barriers and terminal connectors for a given current rating of the breaker (10). The terminal barrier system (140) protects the terminals (16, 18) of the circuit breaker during short circuit condition operations, prevents pole to pole electrification and prevents accidental contact with live electrical wires in the contacts (42, 44). The circuit breaker (10) also includes a molded case (12), a first and second terminal (18, 16) mounted in the case (12), the first contact (44) electrically coupled to the first terminal (18) and a second contact (42) electrically coupled to the second terminal (16). An operating mechanism (40) having a pivoting member (13) movable between an ON position, and OFF position and a TRIPPED position is coupled to the second contact (44). An intermediate latch mechanism (52) mounted in the housing (12)is coupled to the operating mechanism (40) and is selectively operated by a trip unit (60) coupled to the second contact (42) and the second terminal (16). An electric arc extinguishing apparatus (105) is mounted in the housing (12) and positioned in confronting relation with the first and second contact. (42, 44)

25 Claims, 9 Drawing Sheets

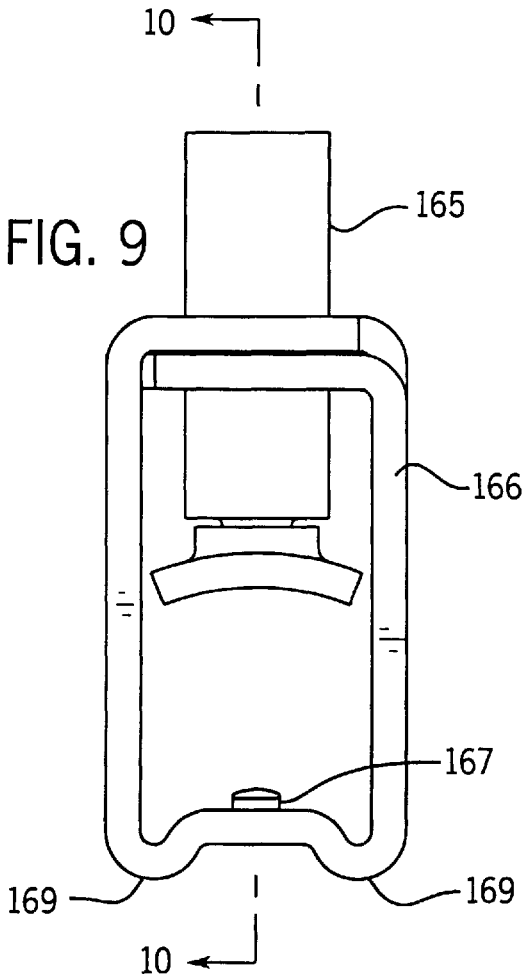
FIG. 9
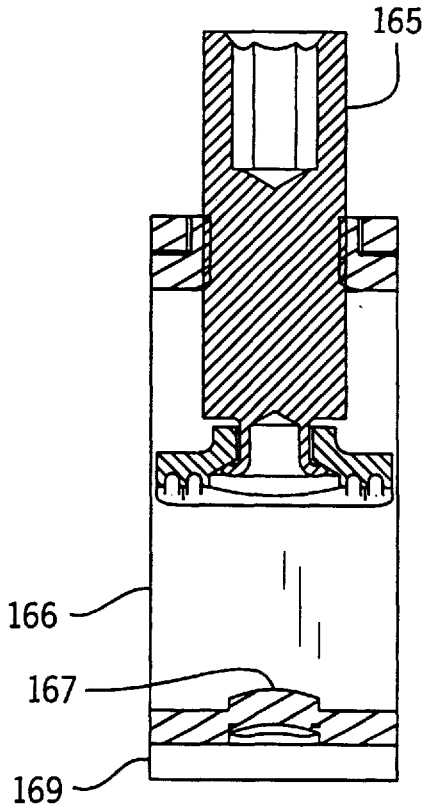
FIG. 10
FIG. 11
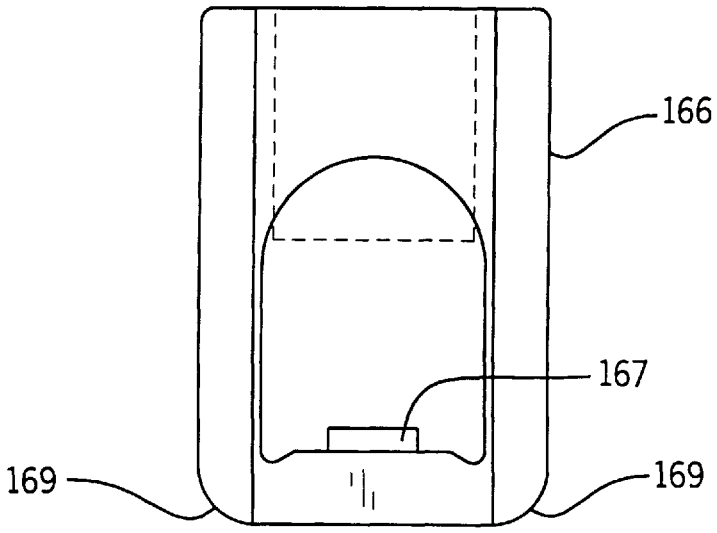

TERMINAL BARRIER SYSTEM FOR MOLDED CASE CIRCUIT BREAKER

FIELD OF THE INVENTION

The present invention relates generally to a field of circuit breakers, and more particularly to a molded case circuit breaker terminal barrier system.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as 1600 amps. The tripping mechanism for the breaker usually consists of a thermal overload release and a magnetic short circuit release. The thermal overload release operates by means of a bi-metalic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross-section and related elements are specifically selected for such current range resulting in a number of different circuit breakers for each current range.

In the event of current levels above the normal operating level of the thermal overload release, it is desirable to trip the breaker without any intentional delay, as in the case of a short circuit in the protected circuit, therefore, an electromagnetic trip element is generally used. During the short circuit condition operation of the circuit breaker gas and plasma is generated as the contacts in the circuit breaker move apart. Such gasses are directed into an arc chute for expulsion outside of the circuit breaker. That expulsion usually occurs at or near line terminals which can damage the cable connection, the terminals themselves or cause arcing on a pole-to-pole or pole-to-ground basis as the gas and plasma exit the circuit breaker. In addition, accidental contact with the live connectors of the circuit breaker should be avoided by the operator or installer of the circuit breaker. Further, it is desirable to reduce the likelihood that a small object accidentally dropped, for example a bolt or a nut, could become lodged underneath the breaker terminals in a manner that would reduce electrical clearances.

Thus, there is a need for a terminal barrier system that will protect the circuit breaker terminals from the gasses generated during a short circuit operation of the circuit breaker. There is also a need to provided a terminal barrier system that prevents pole to pole electrification. There is a further need to provide a barrier terminal system that prevents accidental contact with the live electrical connections in a circuit breaker. There is a further need for a terminal barrier system that will help prevent small objects from accidentally becoming lodged underneath the breaker terminals. Further, there is a need for a terminal barrier system that has interchangeable parts to accommodate a range of continuous current ratings of circuit breakers.

SUMMARY OF THE INVENTION

A circuit breaker of the present invention includes a terminal barrier system. The terminal barrier system comprises a terminal barrier attached to the circuit breaker base at the terminals, line and load, of the breaker and a terminal connector mounted in the terminal barrier to align with a terminal of the breaker. Several embodiments of the terminal barrier and terminal connector are provided which allow flexibility in combining the various terminal barriers and terminal connectors for a given current rating of the breaker. The terminal barrier system protects the terminals of the circuit breaker during short circuit condition operations, prevents pole-to-pole and pole-to-ground electrification and prevents accidental contact by persons or small objects with live electrical conductor at the breaker terminal. The circuit breaker also includes a molded case, a first and second terminal mounted in the case, the first contact electrically coupled to the first terminal and a second contact electrically coupled to the second terminal. An operating mechanism having a pivoting member movable between an ON position, and OFF position and a TRIPPED position is coupled to the second contact. An intermediate latch mechanism mounted in the housing is coupled to the operating mechanism and is selectively operated by a trip unit coupled to the second contact and the second terminal. An electric arc extinguishing apparatus is mounted in the housing and positioned in confronting relation with the first and second contact.

BRIEF DESCRIPTION OF THE DRAWINGS

FIG. 9 is an end plan view of an embodiment of a connector lug.

FIG. 10 is a section view of the connector lug shown in FIG. 9 along the line 10—10.

FIG. 11 is an end plan view of another embodiment of a connector lug.

DETAILED DESCRIPTION OF THE PREFERRED EMBODIMENTS

Figure 1:
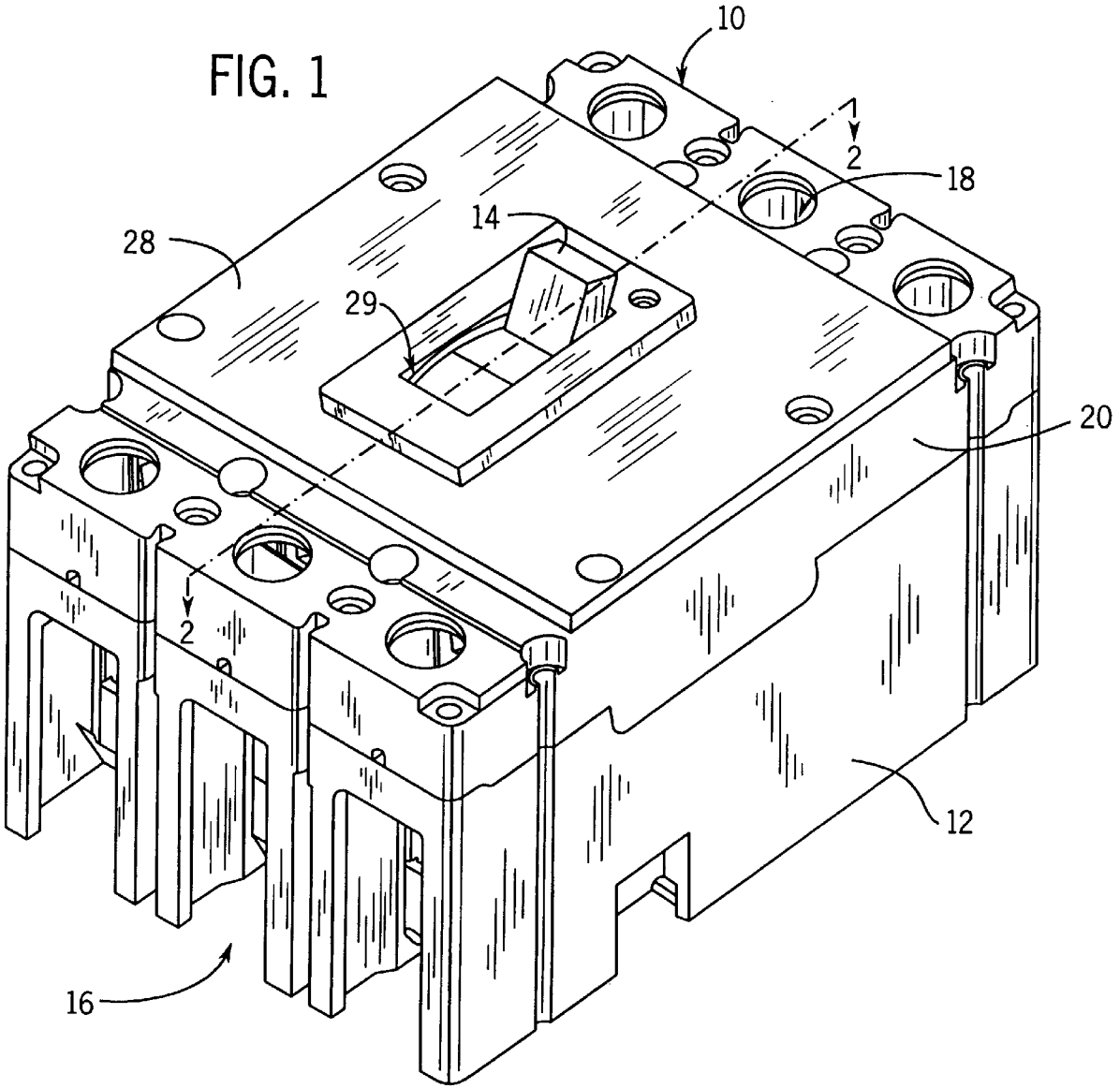
FIG. 1 is a perspective view of a molded case circuit breaker which includes an embodiment of the present terminal barrier system.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
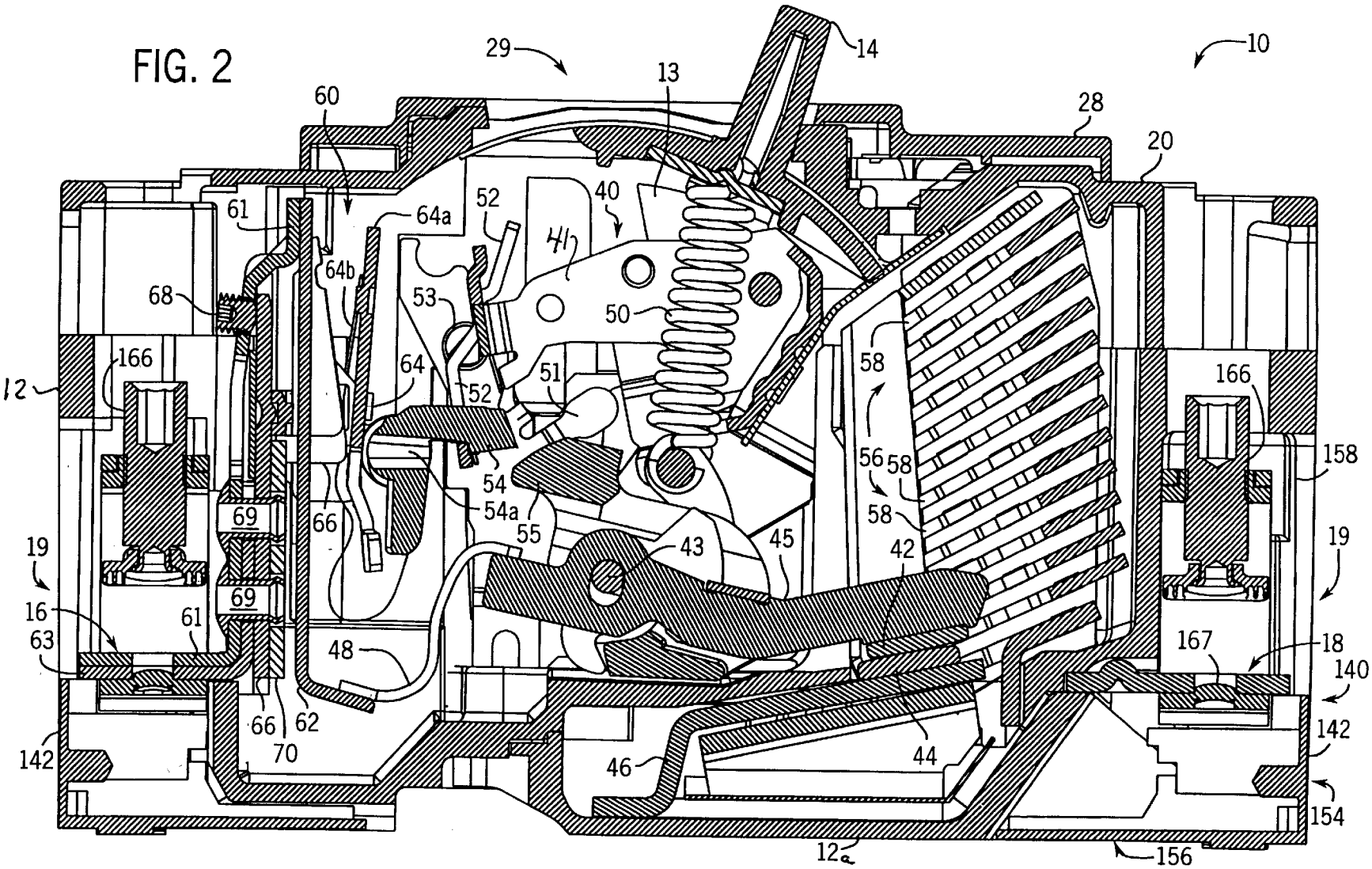
FIG. 2 is a section view of the circuit breaker shown in FIG. 1 along the lines 2—2 and is used to describe the operation of one embodiment of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a sub-base 12*a,* a main circuit breaker cover 20 and an accessory cover 28, with the main breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a,* responsive to a force exerted by a bi-metalic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bi-metalic element 62 and from the bi-metalic element 62 to the load terminal 16. (See FIG. 2*a*) When the current flowing through the circuit breaker exceeds the rated current for the breaker, it heats the bi-metalic element 62, causing the element 62 to bend towards the trip bar 54. If the over current condition persists, the bi-metalic element 62 bends sufficiently to engage the trip bar surface. As the bi-metalic element engages the trip bar surface and continues to bend, it causes the trip bar 54 to rotate in a counter clockwise direction releasing the intermediate latch 52 and thus unlatching the operating mechanism 40 of the circuit breaker.

Figure 2A:
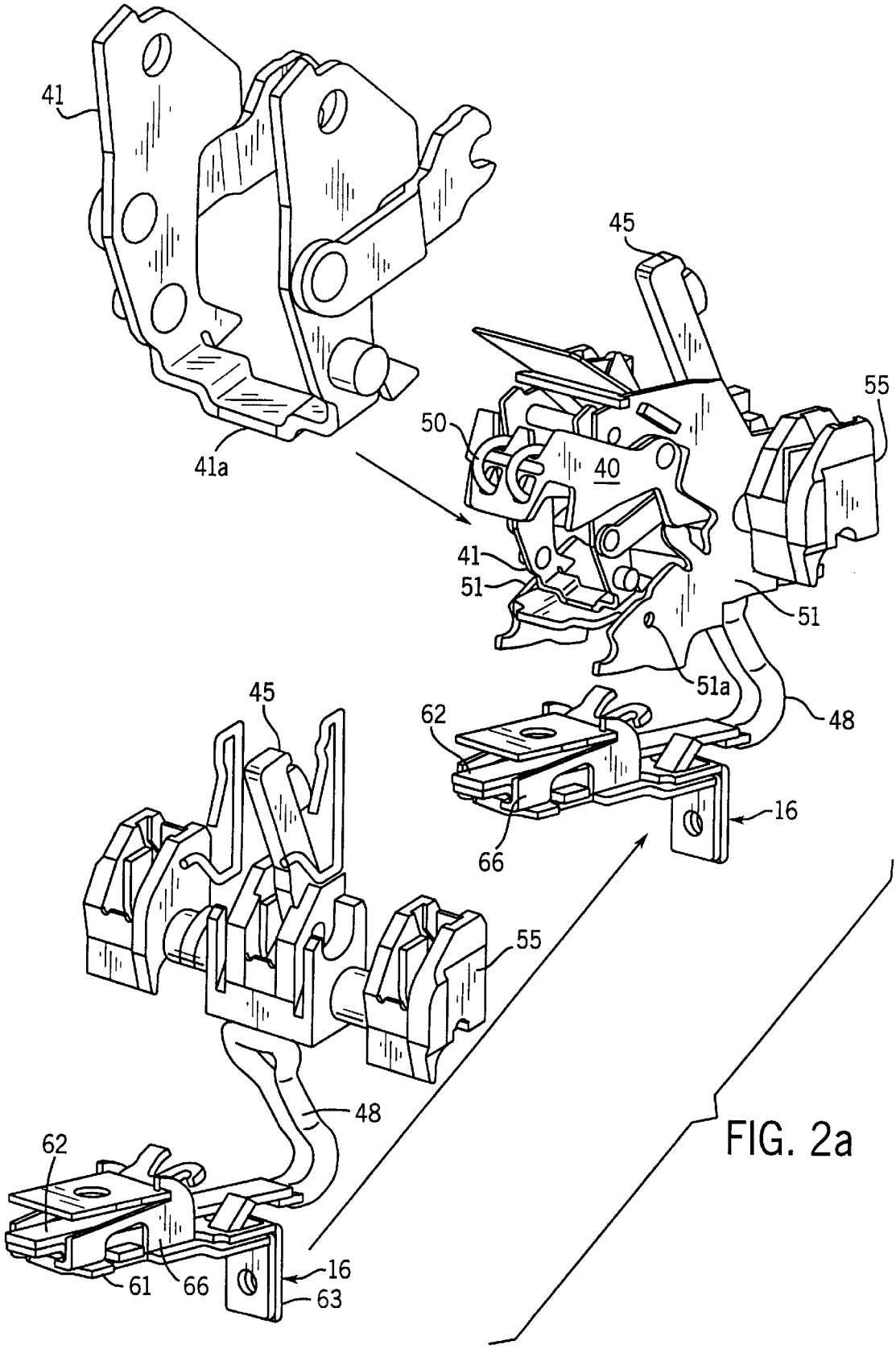
FIG. 2*a* is an exploded isometric drawing of the operating mechanism, contact structure and bi-metal trip unit of the circuit breaker shown in FIG. 1.

FIG. 2*a* is an exploded isometric drawing which illustrates the construction of a portion of the circuit breaker shown in FIG. 2. In FIG. 2*a* only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bi-metalic element 62 by a flexible conductor 48 (e.g. braided copper strand). As shown in FIG. 2*a,* current flows from the flexible conductor 48 through the bi-metalic element 62 to a connection at the top of the bi-metalic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 2*a,* the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

Figure 2B:
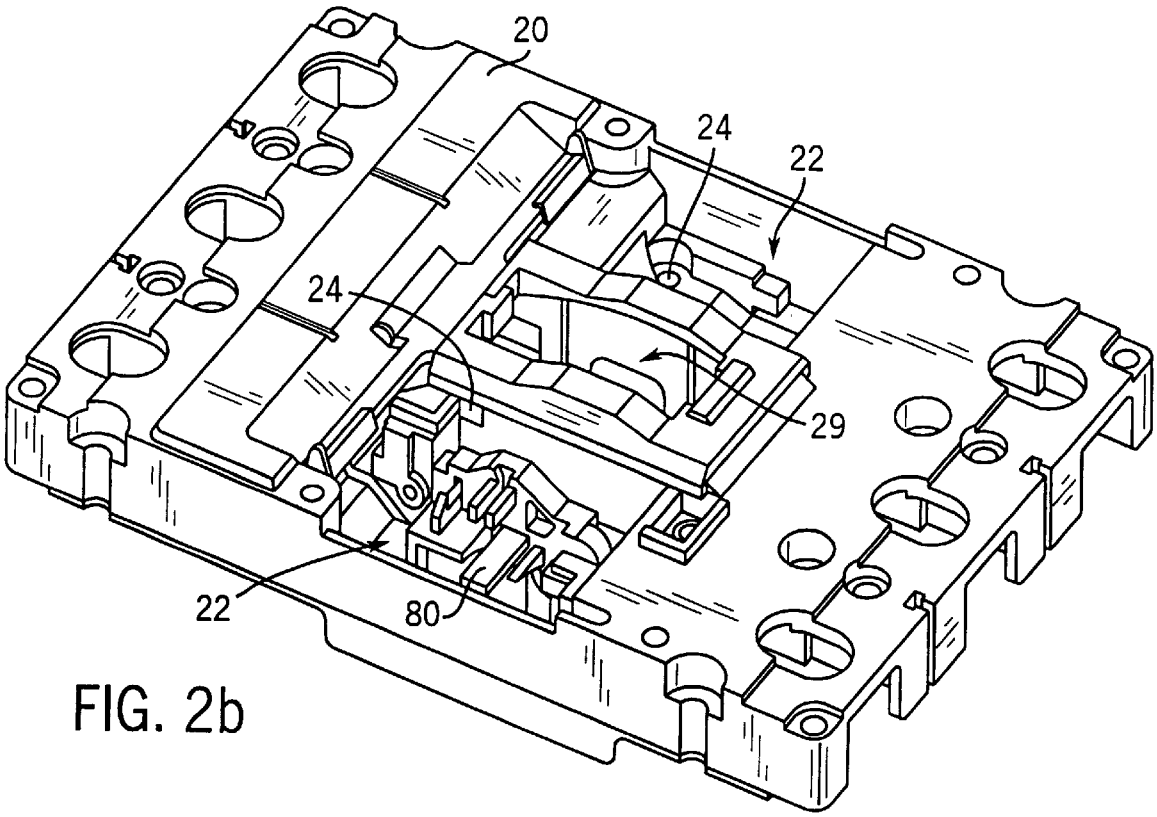
FIG. 2*b* is an illustration of the circuit breaker cover for the circuit breaker shown in FIG. 1.

FIG. 2*b* illustrates the main breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The main breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such as a shunt trip, will trip the circuit breaker 10, upon receiving a remote signal, by pushing the trip bar 54 in a counter clockwise direction causing release of the mechanism latch 52 of the operating mechanism 40. The shunt trip has a member protruding through one of the openings in the accessory socket 22 and engages the operating mechanism 40. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

Figure 8:
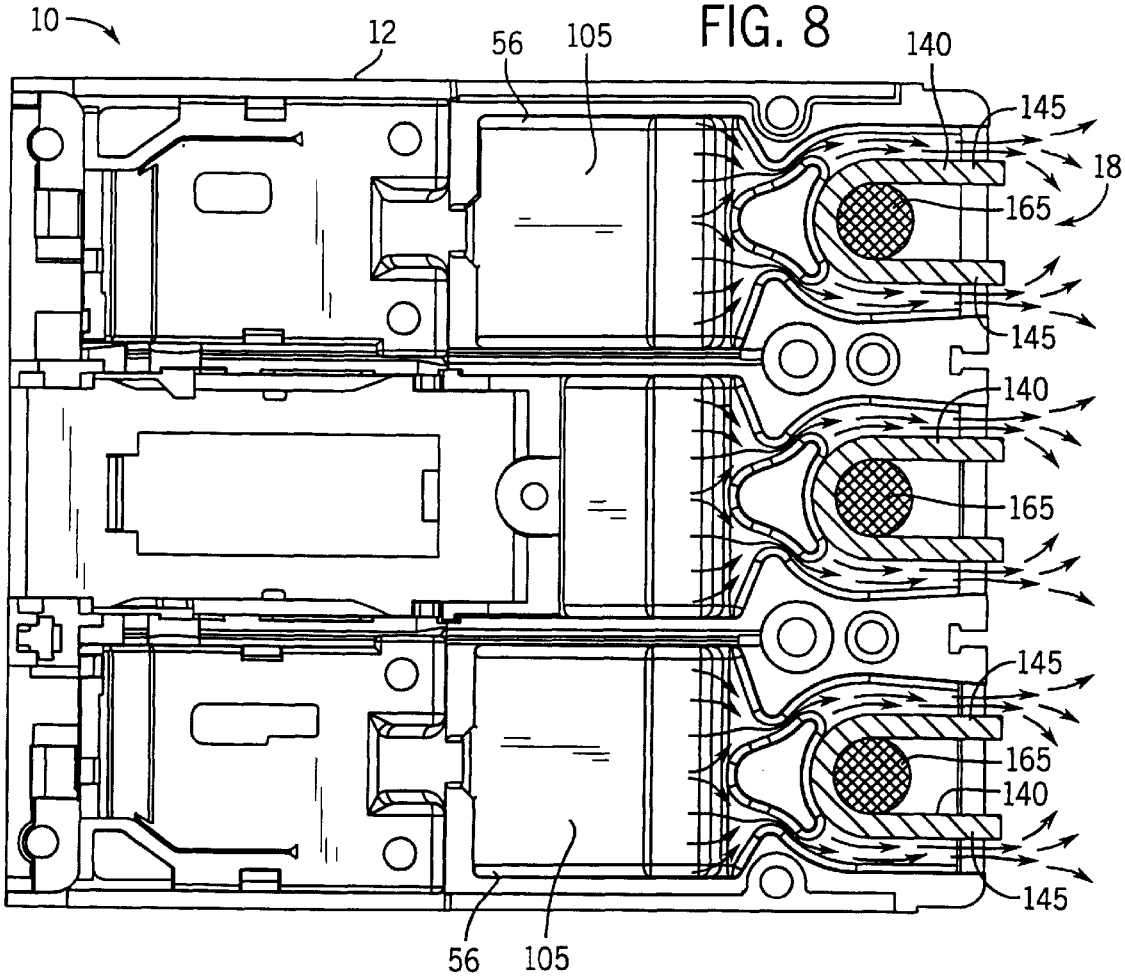
FIG. 8 is a bottom plan view of the circuit breaker housing shown in FIG. 7 containing the operating mechanism, arc chute, line terminals and an embodiment of the present terminal barrier system illustrating the flow of gas generated during a short-circuit trip condition of the circuit breaker.

In normal operation and especially in operation under a short circuit condition, the circuit breaker 10 generates gasses in the arc chamber 56. These gasses, are expelled from the breaker 10 through the arc chute assembly 105 in each of the poles of the circuit breaker 10. FIG. 8 illustrates a typical gas flow from the arc chute assemblies 105 past the line terminals 18 of the circuit breaker 10. A terminal barrier system 140 is provided for each terminal 16, 18. Although, in typical circuit breaker operation gasses are expelled usually only from the line terminal 18 side of the circuit breaker 10, the terminal barrier system 140 is also used on the load side of the breaker since there are other functions of the terminal barrier system 140 disclosed herein and will be described below.

Figure 3A:
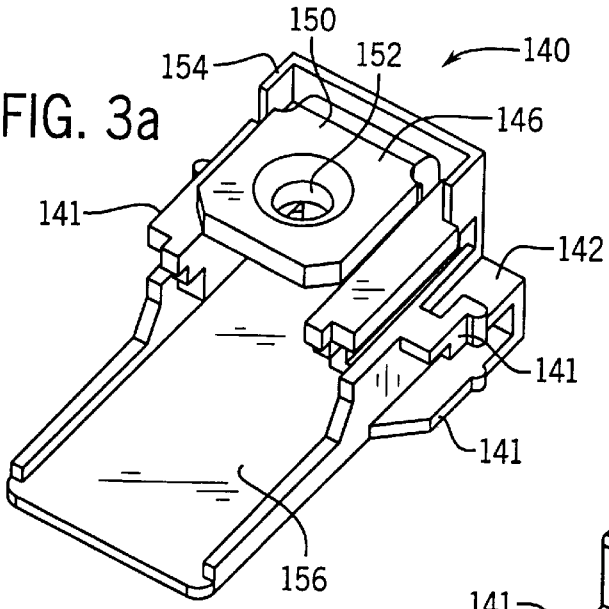
FIG. 3*a* is a perspective view of an embodiment of the terminal barrier and a nut plate.

There are several embodiments for the terminal barrier system 140 with interchangeable parts to provide a range of protection and electrical clearances for various operating current ratings of the circuit breakers. The terminal barrier system 140 generally comprises the terminal barrier 142 which attaches to the circuit breaker base 12 at the line terminal 18 and load terminal 16 and a terminal connector 144 which is mounted in the terminal barrier 142 and aligns with the terminal 16, 18 of the circuit breaker 10. FIGS. 3*a,* 3*b,* 3*c,* 4, 5 and 7 illustrate several embodiments of the present terminal barrier system 140.

Figure 7:
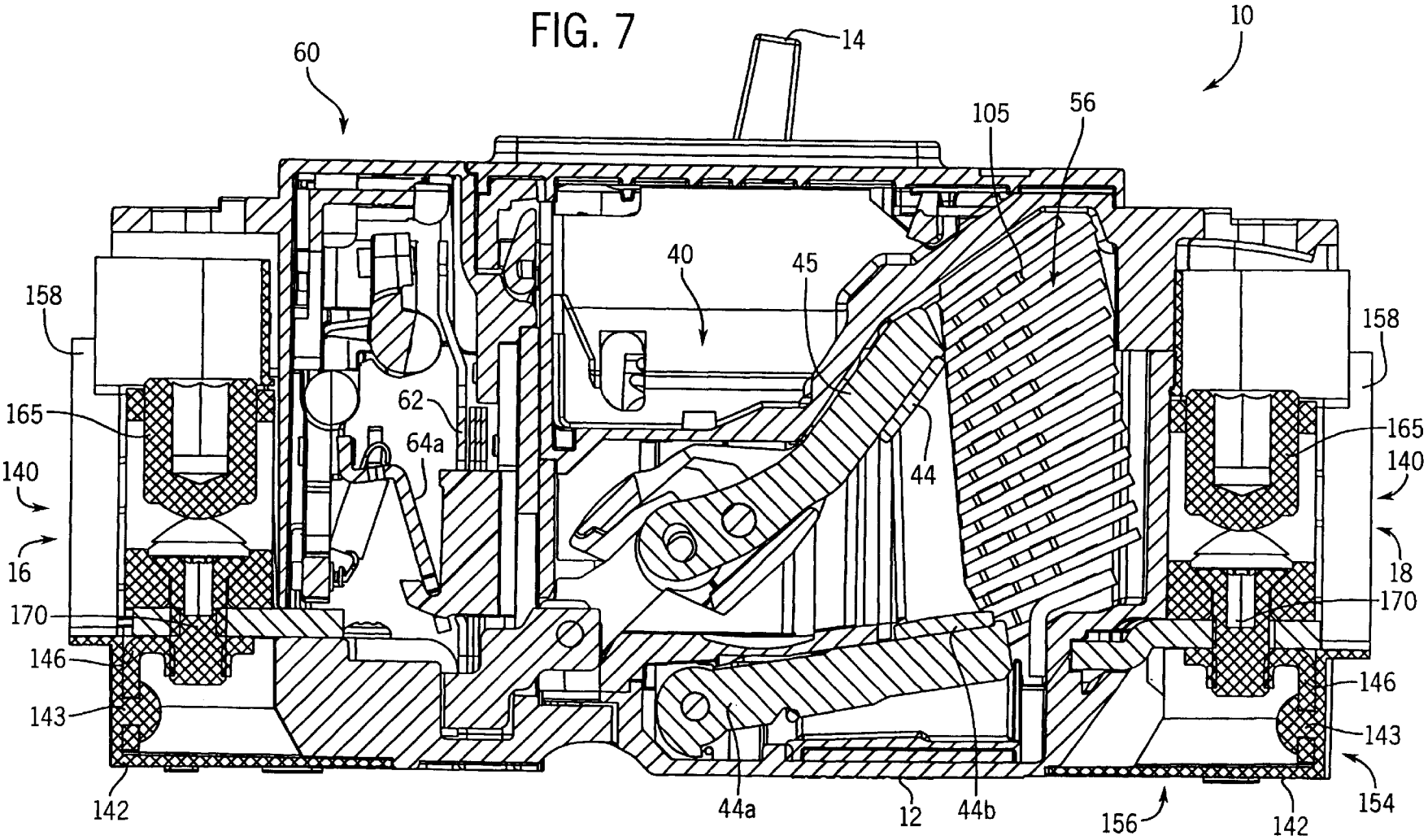
FIG. 7 is a sectional side view of another embodiment of the present circuit breaker having a housing containing the operating mechanism, arc chute, line terminal and an embodiment of the present terminal barrier system and a housing containing an embodiment of a trip unit and load terminal.

One embodiment of the terminal barrier system 140 is provided with a nut plate 146 type terminal connector 144. The nut plate 146 has a mounting portion 148 which is provided with a substantially central hole. See FIG. 4. The mounting nut 146 also has aligned at a substantially right angle to the mounting portion 148 a terminal hole portion 150. The terminal hole portion 150 is provided with a substantially central hole 152 that is threaded to receive a mounting fastener 170. The mounting fastener can be used to attach the terminal barrier system 140 directly to the circuit breaker terminal 16 or 18, or can be used to mount a connector lug 166 (as will be described below) or can be used to attach a cable connector or bus strap to the terminals, 16 or 18. The nut plate is attached to the terminal barrier 142 by staking the mounting portion 148 to a mounting post 143. The attachment can be done by ultra-sound or by heating. It could also be accomplished with a rivet or threaded fastener. When the nut plate is mounted in the terminal barrier 142, the terminal hole portion 150 of the terminal connector 144 is offset, that is not touching the terminal portion 154 (FIG. 3*a,* 3*b,* 3*c*) as explained below, from the terminal barrier 142. The right angle feature of the nut plate 146 formed by the mounting portion 148 and the terminal hole portion 150 improves electrical creepage and through-air clearances for applicable electrical ratings and standards. When so mounted as shown in FIGS. 3*a,* 3*b,* 3*c* and 7, the cantilevered terminal hole portion 150 of the terminal connector 144 does not touch the sidewalls 160 of the terminal barrier 142. The terminal barrier 142 has a terminal connection portion 154 and a shield portion 156. The nut plate 146 installation described above places the nut plate 146 in the terminal connection portion 154 of the terminal barrier 142. The shield portion 156 can be of a size and shape that encloses the lower side of the circuit breaker base 12 and depends on the particular design of the molded circuit breaker housing 12. FIGS. 2 and 7 illustrate two embodiments of the shield portion 156 mounted into two embodiments of the present circuit breaker 10.

Another embodiment of the terminal barrier system 140 provides the shield portion 156 with a shield extension 158, see FIGS. 4, 5, 6 and 7. The shield extension 158 comprises of a pair of spaced apart parallel sidewalls 160 and a cross piece 162 connecting the two sidewalls 160 at one end. The length of the sidewalls 160 can be of any convenient dimension depending on the size and rating of the circuit breaker to which it is mounted. FIG. 7 illustrates an embodiment of the terminal barrier system 140 having a shield extension 158. The cross piece 162 connects the two sidewalls 158 but also provides a protection of a clamp screw 165 and protects the terminal during gas expulsion on the line side of the circuit breaker 10 (see FIG. 8). The shape and dimensions of the cross piece 162 can be selected in accord with the specific application and current rating of the circuit breaker 10.

Another embodiment of the terminal barrier system 140 provides that each sidewall 160 has a mounting rib 164 with a terminal connector 144 being a connector lug 166 mounted in the shield extension 158 shield portion 156 of the terminal barrier 142. The connector lug 166 is provided with a slot 168 corresponding to the mounting rib 164 for securing the lug 166 in the shield extension 158 shield portion 156. See FIG. 5. The mounting rib 164 can be molded into the sidewall 160 of the shield extension 158. The mounting rib 164 fitting into a slot 168 in the terminal connector 144 provides a snap fit retention so that the terminal barrier 142 and the terminal connector 144 can be assembled as a unit. The slots 168 in the terminal connector 144 are longer than the mounting rib 164 and allow the connector 144 to slide vertically with respect to the shield extension 158. This allows the connector dowel 167 to enter the terminal hole 152. Prior to tightening the cable clamp 165 to the terminal, 16, 18, a resilient member 155 retains the connector lug 166 in place. (See FIG. 5) Further, after the load or line cable is installed and the cable clamp 165 is tightened, the connector 144 is secured to the terminal 16, 18. The rib 164 engaged in the slot 168 prevents the shield extension 158 of the shield portion 156 of the terminal barrier 142 of the present terminal barrier system 140 from becoming separated from the circuit breaker 10 during a short circuit interruption. The gasses generated during the breaker operation outgassing from the arc chamber 56 tends to blow against the terminal barrier 142. The mounting ribs 164 assist in keeping the terminal barrier 142 installed in the circuit breaker.

Another embodiment of the terminal barrier system 140 provides a connector lug 166 type of terminal connector 144 mounted in the shield portion 156 and connected to the circuit breaker terminal 16, 18 with the fastener 170. See FIG. 7. The connector lug can be fabricated from steel or aluminum and fits within the sidewalls 160 of the shield portion 156 and specifically within the shield extension 158 portion of the terminal barrier 142 of the terminal barrier system 140. The lug may be coated with an appropriate electrical conducting corrosion resistant plating.

Figure 3B:
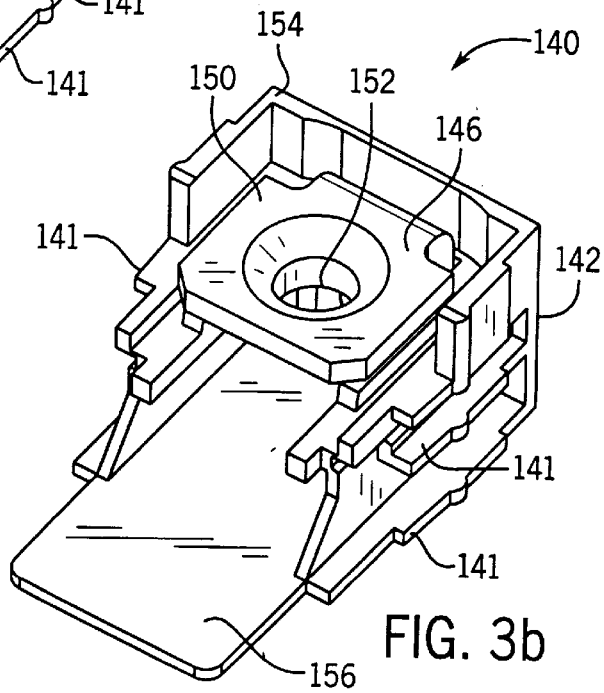
FIG. 3*b* is a perspective view of another embodiment of the terminal barrier and a nut plate.
Figure 3C:
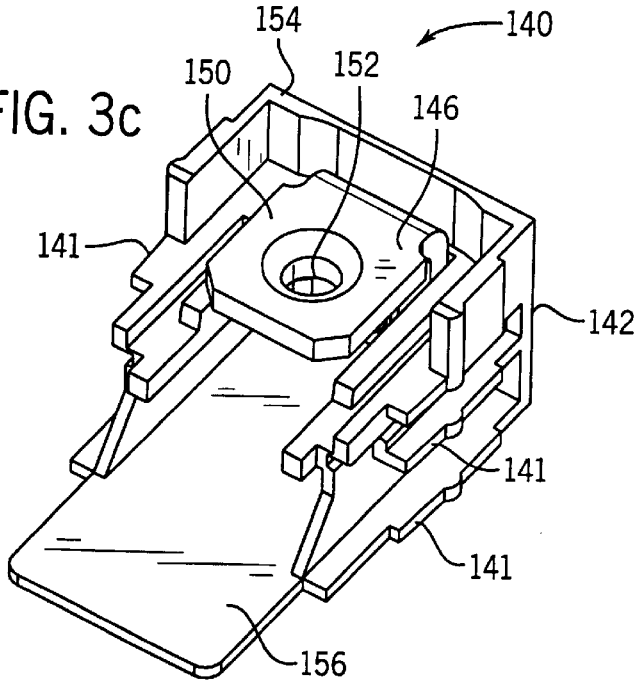
FIG. 3*c* is a perspective view of another embodiment of the terminal barrier and a nut plate.
Figure 5:
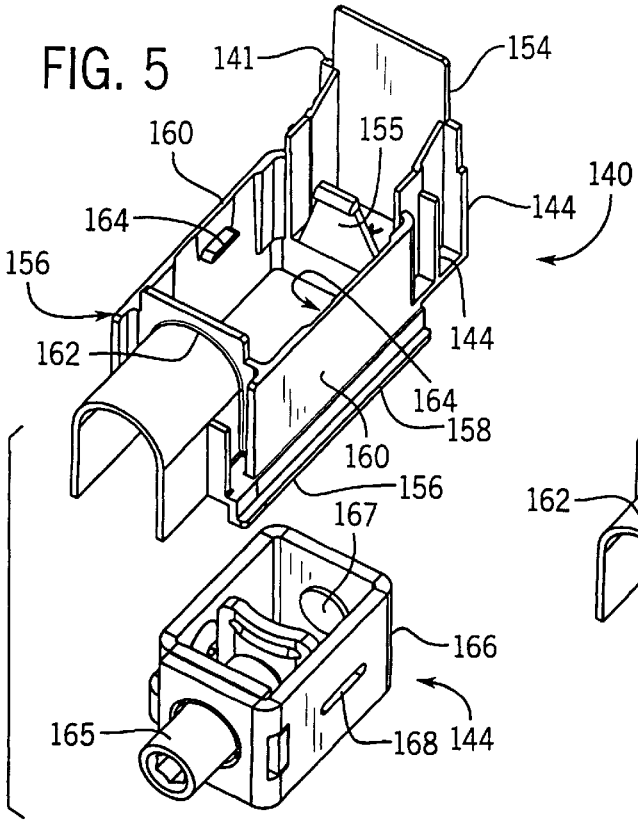
FIG. 5 is an exploded view of another embodiment of the terminal barrier with a shield extension and a connector lug.
Figure 6:
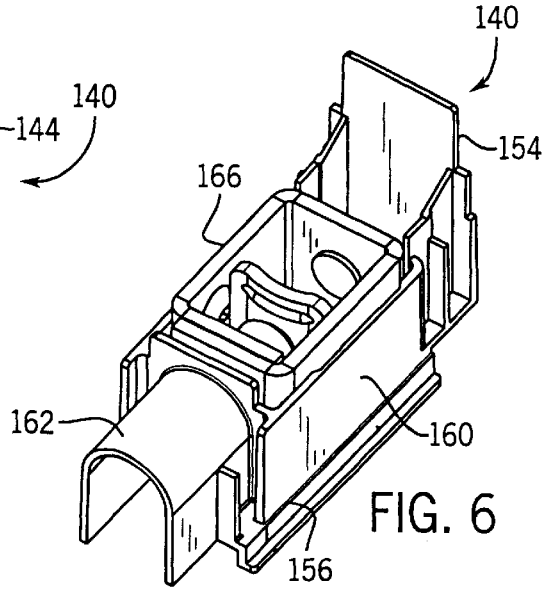
FIG. 6 is a perspective view of the terminal barrier shown in FIG. 5 with the connector lug mounted in the shield extension.
Figure 4:
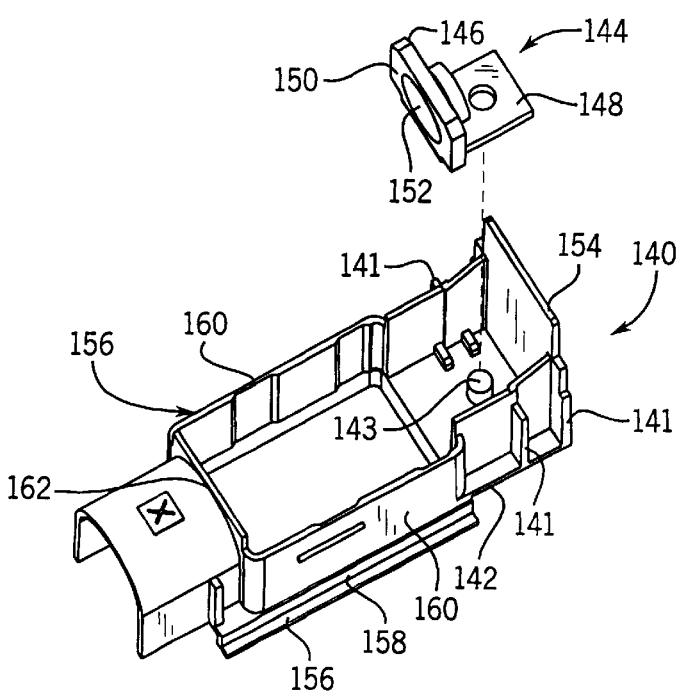
FIG. 4 is a perspective view of another embodiment of the terminal barrier with a shield extension and a nut plate.

The various embodiments described above provide a system in which the various parts such as the terminal barrier 142 of the type illustrated in FIGS. 3*a*, 3*b* and 3*c* or the type illustrated in FIG. 4, or 6 or 7 can be assembled with several embodiments of the terminal connector 144. The nut plate 146 can be fabricated in steel or aluminum or copper and can have different cross sectional thicknesses depending upon the current rating for the circuit breaker 10 application. The nut plate 146 may be coated with an electrical conductive, corrosion resistant plating.

The terminal barrier system 140 is installed in the circuit breaker housing base 12 by inserting the terminal barrier system 140 within a separate molded pole area for each pole of the circuit breaker 10. The same arrangement for the line side 18 and the load side 16 terminals of the circuit breaker can be utilized or different terminal barrier 142/terminal connector 144 combinations can be utilized. One embodiment of the terminal barrier system 140 provides the terminal barrier 142 with a plurality of protrusions 141 that correspond to a plurality of slots 145 in the housing base 12 of the circuit breaker 10 to attach the terminal barrier 142 to the circuit breaker 10. It should be understood that it is also possible that the terminal barrier 142 is provided with a plurality of slots that correspond to a plurality of protrusions in the housing base 12 of the circuit breaker 10 to attach the terminal barrier 142 to the circuit breaker 10.

The line terminal 18 and load terminal 16 of a typical circuit breaker is provided with a hole for purposes of mounting the cable from the line source to the load device. The hole in the terminal is aligned with the hole 152 in the nut plate 146 and the two are fastened together with an appropriate fastener such as a screw, bolt or a rivet. If the connector lug 166 type terminal connector 144 is utilized, a fastener 170 can be used to attach the terminal barrier system 140 to each circuit breaker terminal 16, 18 in a manner similar to that used with the nut plate 146 or with a dowel 167 formed in one side of the connector lug 166 that engages the hole in the circuit breaker terminal 16, 18. Such arrangement fixes the connector lug 166 in the terminal barrier 142 in position when the clamping screw 165 of the connector lug 166 is tightened against a cable inserted into the connector lug 166. Several types of connector lugs are illustrated in FIGS. 7, 9, 10 and 11 which are configured to mate with the several embodiments of the terminal barrier 142 of the present terminal barrier system 140.

In another embodiment, as shown in FIG. 2, the terminal barriers 142 without extensions as shown in FIG. 3*a*, 3*b*, and 3*c* provide for the retention of the terminal connectors shown in FIGS. 9, 10, and 11. In this embodiment the nut plate 146 is omitted. The terminal barrier 142 retains the connector lug 166 in engagement with the terminal prior to installation of the cable. Either the formed sheet metal lug in FIG. 9 or the extruded metal lug shown in FIG. 11 may be used. The embossed rib 169 in FIG. 9 is dimensioned similarly to feature 169 in the extruded lug in FIG. 11. This allows either of the two lugs to be retained by the same plastic terminal barriers 142.

The terminal barrier system 140 in addition to the function of protecting the terminal during outgassing operation of the circuit breaker 10, also functions to retain the terminal connector 144 and prevents accidental contact with live terminals by an operator and installer of the circuit breaker 10. The terminal barrier can be formed or fabricated from any suitable electrical insulating material such as plastic or similar composition.

Another embodiment of the terminal barrier system 140 provides for a terminal barrier 142 that engages a cable bus connector. The cable bus connector is inserted into the terminal barrier 142 and fastened to the terminal barrier 142 by either a pin or threaded fastener. The cable bus connector has a flattened portion which connects to the line or load cable. The terminal barrier 142 mounts to the circuit breaker terminal 16, 18 with a mounting fastener 170. Such arrangement allows the line and load cables to be attached to the circuit breaker 10 from underneath or rear of the circuit breaker 10 rather than from the side of the circuit breaker. FIGS. 1, 2 and 7 illustrate the circuit breaker 10 orientated for a side connection of the line or load cables.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example, other types of electrical conducting material can be utilized in the connector lugs or nut plates and different shapes can be utilized for the terminal connector. Although an individual terminal barrier system is utilized at each pole of the circuit breaker, it is contemplated that a multiple pole terminal barrier system can also be utilized. It is also contemplated tht an electronic trip unit can be used. Additionally, it is also contemplated that the trip mechanism having a bi-metal trip unit or an electronic trip unit with a load terminal be housed in a separate housing capable of mechanically and electrically connecting to another housing containing the operating mechanism and line terminal thereby providing for a quick and easy change of current readings for an application of the circuit breaker contemplated herein. Other modifications will be evident to those with ordinary skill in the art.

What is claimed is:

1. A terminal barrier system for a circuit breaker, with the circuit breaker having a housing base with a terminal for a load and a terminal for a line connection, the terminal barrier system comprising:

a terminal barrier attached to the circuit breaker housing base at the terminals; and, a terminal connector configured as a nut plate having a mounting portion aligned at a right angle to a terminal hole portion, with the mounting portion attached to the terminal barrier and the terminal hole portion off-set from the terminal barrier, the terminal connector aligned with at least one of the terminals of the breaker.

2. The terminal barrier system of claim 1, wherein the terminal barrier includes a terminal connection portion and a shield portion.

3. The terminal barrier system of claim 2, wherein the shield portion includes a shield extension having a pair of spaced apart parallel side walls and a cross piece connecting the two side walls at one end.

4. The terminal barrier system of claim 3, wherein each side wall is provided with a rib and the terminal connector is a connector lug mounted in the shield extension, with the connector lug having a slot corresponding to the rib for securing the connector lug in the shield extension.

5. The terminal barrier system of claim 3, wherein the terminal connector is a connector lug mounted in the shield extension and connected to one of the circuit breaker line and load terminals with a fastener.

6. The terminal barrier system of claim 1, wherein the terminal barrier is provided with a plurality of protrusions that correspond to a plurality of slots in the housing base of the circuit breaker to attach the terminal barrier to the circuit breaker.

7. The terminal barrier system of claim 1, wherein the terminal barrier is provided with a plurality of slots that correspond to a plurality of protrusions in the housing base of the circuit breaker to attach the terminal barrier to the circuit breaker.

8. A molded case circuit breaker comprising:

a molded case including a main cover;

a first terminal and a second terminal inserted in the case;

a first contact electrically coupled to the first terminal;

a second contact electrically coupled to the second terminal;

an operating mechanism having a pivoting member moveable between an ON position, an OFF position and a TRIPPED position, wherein the pivoting member is coupled to the second contact;

an intermediate latching mechanism mounted in the case and coupled to the operating mechanism;

a trip unit coupled to the second contact and the second terminal with the trip unit in selective operative contact with the intermediate latching mechanism;

an electric arc extinguishing apparatus mounted in the housing and positioned in confronting relation with the first and second contacts; and, a terminal barrier system comprising:

a terminal barrier attached to the circuit breaker case at the terminals; and, a terminal connector configured as a nut plate having a mounting portion aligned at a right angle to a terminal hole portion, with the mounting portion attached to the terminal barrier and the terminal hole portion off-set from the terminal barrier, the terminal connector aligned with at least one of the terminals of the breaker.

9. The terminal barrier system of claim 8, wherein the terminal barrier includes a terminal connection portion and a shield portion.

10. The terminal barrier system of claim 9, wherein the shield portion includes a shield extension having a pair of spaced apart parallel side walls and a cross piece connecting the two side walls at one end.

11. The terminal barrier system of claim 10, wherein each side wall is provided with a rib and the terminal connector is a connector lug mounted in the shield extension, with the connector lug having a slot corresponding to the rib for securing the connector lug in the shield extension.

12. The terminal barrier system of claim 10, wherein the terminal connector is a connector lug mounted in the shield extension and connected to one of the circuit breaker line and load terminals with a fastener.

13. The terminal barrier system of claim 8, wherein the terminal barrier is provided with a plurality of protrusions that correspond to a plurality of slots in the housing base of the circuit breaker to attach the terminal barrier to the circuit breaker.

14. The terminal barrier system of claim 8, wherein the terminal barrier is provided with a plurality of slots that correspond to a plurality of protrusions in the housing base of the circuit breaker to attach the terminal barrier to the circuit breaker.

15. A circuit breaker comprising:

a molded housing including a base;

a means for connecting a load to the circuit breaker, mounted in the housing;

a means for connecting an electrical line to the circuit breaker;

a means for coupling electrically to the means for connecting an electrical line;

a movable means for contacting the means for connecting an electrical line to a means for operating mounted in the housing coupled with the means for operating having a pivoting member movable between an ON position, an OFF position, and a TRIPPED position, with the pivoting member coupled to the movable means for contacting and with the means for operating coupled to an intermediate means for latching the means for operating;

a means for tripping coupled to the movable means for contacting and the means for connecting a load with the intermediate means for latching, wherein the means for tripping includes a means for releasing under a short circuit condition and a means for releasing under an overload condition;

a means for extinguishing an electric arc mounted in the housing with the movable means for contacting extending into the means for extinguishing; and, a means for shielding the means for connecting the load and means for connecting the line, mounted in the base with each means for connecting off-set from the means for shielding.

16. The circuit breaker of claim 15, wherein means for connecting a load and the means for connecting an electric line is mounted in the means for shielding.

17. The circuit breaker of claim 16, wherein the means for shielding includes a shield extension having a pair of spaced apart parallel sidewalls and a cross piece connecting the two sidewalls at one end.

18. The circuit breaker of claim 17, wherein the means for shielding includes a means for securing the means for connecting a load and the means for connecting electric line in the means for shielding.

19. The circuit breaker of claim 15, wherein the means for shielding includes a means for attaching the means for shielding to the circuit breaker base.

20. A method of assembling a terminal barrier and terminal connector system for a molded case circuit breaker having a housing base with a load terminal, a line terminal, an operating mechanism connected to the line terminal, an intermediate latching mechanism in selective contact with the operating mechanism, a trip unit coupled to the intermediate latching mechanism and the load terminal, the method comprising the steps of:

providing a terminal barrier having a mounting post in a terminal connection portion and protrusions on a shield portion;

providing a terminal connector;

attaching the terminal connector to the mounting post;

installing the terminal barrier and attached terminal connector in the housing base of the circuit breaker, the terminal barrier configured with an off-set from the attached terminal connector; and;

securing the terminal barrier and attached terminal connector to the housing and one of the line terminal and load terminal.

21. The method of claim 20, including the step of selecting the terminal connector from one of a nut plate and a connector lug.

22. The method of claim 21, including the step of providing a terminal barrier having a shield extension comprising two spaced apart, parallel side walls and a cross piece, with each side wall of the shield extension having a mounting rib aligned to engage a mounting slot in the connector lug type terminal connector.

23. The method of claim 21, including the step of providing a terminal barrier having a shield extension comprising two spaced apart, parallel side walls and a cross piece, with the mounting post aligned to engage the nut plate type terminal connector.

24. The method of claim 21, including the step of providing a terminal barrier having a shield extension comprising two spaced apart, parallel side walls and a cross piece, with the barrier having a resilient member aligned to retain a connector lug type terminal connector.

25. The method of claim 20, wherein the step of securing includes fastening the terminal connector with a mounting fastener to the terminal.

* * * * *